United States Patent [19]

Wedel et al.

[11] Patent Number: 5,020,238

[45] Date of Patent: Jun. 4, 1991

[54] VACUUM GUIDE ROLL APPARATUS

[75] Inventors: Gregory L. Wedel; Arnold J. Roerig, both of Beloit, Wis.

[73] Assignee: Beloit Corporation, Beloit, Wis.

[21] Appl. No.: 525,380

[22] Filed: May 17, 1990

Related U.S. Application Data

[62] Division of Ser. No. 429,592, Oct. 31, 1989, Pat. No. 4,974,340.

[51] Int. Cl.[5] ..... F26B 5/04; F26B 11/02

[52] U.S. Cl. ..... 34/16; 34/115

[58] Field of Search ..... 34/115, 116, 117, 120, 34/123, 114, 15, 16, 92

[56] References Cited

U.S. PATENT DOCUMENTS 4,364,185 12/1982 Dussourd et al. ..... 34/115

*Primary Examiner*—Henry A. Bennet

*Attorney, Agent, or Firm*—Dirk J. Veneman; Raymond W. Campbell; David J. Archer

[57] ABSTRACT

A vacuum guide roll apparatus is disclosed for guiding a web between an upstream dryer and a downstream dryer of a dryer section. The apparatus includes a perforate roll shell having a first and a second end. The shell defines an elongate chamber which extends between the first and the second ends. A first and second shaft are rigidly secured to and disposed coaxially relative to the shell. The shafts are disposed adjacent to the first and second ends respectively of the shell. The shafts define respectively a first and second journal. A first and second bearing cooperate with the first and second journals respectively for rotatably supporting the roll shell. A housing is disposed coaxially relative to the shell and adjacent to one of the shafts. The housing defines a passageway which is connected to a source of partial vacuum. A first annular seal is disposed between the housing and the one shaft for sealing the housing relative to the one shaft. A second annular seal is disposed between the housing and the shell for sealing the housing relative to the shell so that when the shell rotates relative to the housing, the passageway is sealingly connected to the elongate chamber such that a partial vacuum is generated within the chamber for urging the web towards the perforate shell.

2 Claims, 2 Drawing Sheets

VACUUM GUIDE ROLL APPARATUS

This is a divisional of copending application(s) Ser. No. 07/429,592 filed on Oct. 31, 1989, now U.S. Pat. No. 4,974,340.

BACKGROUND OF THE INVENTION

1. Field of the Invention

The present invention relates to a vacuum guide roll apparatus and method for guiding a web between an upstream dryer and a downstream dryer of a dryer section. More particularly, the present invention relates to a vacuum guide roll in which the vacuum is supplied via a housing rather than through a support journal.

2. Information Disclosure Statement

Although much of the water is removed from a formed web during passage of the web through a press section, further water must be removed from the web in order to provide a paper web having the requisite printing characteristics and the like.

A dryer section typically includes a plurality of heated dryer drums, or dryers, around which the web to be dried is trained. Various dryer section arrangements have been proposed and it has been found desirable to continuously support the web on one or more dryer felts during transit through the dryer section.

More particularly, the TOTAL BELRUN system provides such web support from press section to calendar. TOTAL BELRUN is a registered trademark of Beloit Corporation. The TOTAL BELRUN system includes dryer drums and vacuum guide rolls disposed between adjacent drums such that the web is brought into intimate contact with the external surface of each dryer drum. By the aforementioned arrangement, the greatest thermal transfer between the dryers and the web is obtained. The web supported by a dryer felt extends around a vacuum guide roll such that the dryer felt is sandwiched between the web and the roll. By the application of vacuum to the guide rolls, any tendency for the web to sag relative to the felt during transit around the guide roll is inhibited.

Furthermore, particularly when the guide roll is disposed in close proximity to the adjacent dryers, the tendency for the web to flutter between a dryer and adjacent guide roll is minimized.

Additionally, by the aforementioned arrangement, the web is effectively restrained during transit through the dryer section so that shrinkage of the web is inhibited.

In the prior art arrangements, particularly with dryer arrangements including an open draw or unsupported span of the web between dryers, such tendency to shrink causes cockling of the resultant web.

In order to provide the necessary relatively high vacuum to guide rolls in order to inhibit the aforementioned problem of cockling, various proposals have been set forth as exemplified by co-pending patent application Ser. No. 07/014,569 to Beloit Corporation. U.S. Ser. No. 07/014,569 teaches incorporating vacuum seals in a guide roll and the like.

In order to simplify the aforementioned arrangement while providing the necessary vacuum level, the present invention includes a perforate shell for applying a vacuum along the cross-machine direction of the web.

Although vacuum guide rolls have been known, such vacuum has been achieved by means of passages defined by the support journals, these passages being connected to a source of partial vacuum. However, the provision of channels, or passageways, through the support journals of a guide roll of necessity require the provision of relatively massive journal bearings.

The present invention seeks to overcome the need for such massive bearings by the provision of a stationary housing disposed adjacent to one end of a perforate roll shell. The housing is connected to a source of partial vacuum. The housing is sealed relative to an adjacent rotatable shaft and roll shell so that vacuum can be pulled through the perforate shell via the housing.

Therefore, it is a primary objective of the present invention to provide a vacuum guide roll apparatus that overcomes the aforementioned inadequacies of the prior art devices and which makes a considerable contribution to the dryer section art.

Another object of the present invention is the provision of a vacuum guide roll apparatus which includes a housing disposed coaxially relative to a perforate roll shell and adjacent to one support shaft rigidly secured to the shell. The housing is connected to a source of partial vacuum and is sealed relative to the shaft and the roll shell so that air is drawn through the perforate shell and the housing for urging the web towards the roll shell.

Another object of the present invention is the provision of a vacuum guide roll which includes a first and second shaft disposed respectively adjacent to a first and second end of a roll shell and rigidly secured thereto so that the vacuum guide roll does not include a continuous center shaft.

Another object of the present invention is the provision of a vacuum guide roll having a housing and a further housing disposed respectively adjacent to a first and second shaft of the roll shell, the arrangement being such that the edges of the web are held against shrinkage thereby preventing cockle and curl of the web.

Other objects and advantages of the present invention will be apparent to those skilled in the art by a consideration of the detailed description contained hereinafter taken in conjunction with the annexed drawings.

SUMMARY OF THE INVENTION

The present invention relates to a vacuum guide roll apparatus and method for guiding a web between an upstream dryer and a downstream dryer of a dryer section. The apparatus includes a perforate roll shell having a first and a second end. The shell defines an elongate chamber which extends between the first and the second ends. A first and a second shaft are rigidly secured to and are disposed coaxially relative to the shell. The first and the second shafts are disposed adjacent to the first and second ends respectively of the shell. The first shaft defines a first journal and the second shaft defines a second journal. A first and second bearing, respectively, cooperate with the first and second journals for rotatably supporting the roll shell. A housing is disposed coaxially relative to the shell and adjacent to one of the shafts. The housing defines a passageway with the passageway being connected to a source of partial vacuum. A first seal means is disposed between the housing and the one shaft for sealing the housing relative to the one shaft. A second annular seal means is disposed between the housing and the shell for sealing the housing relative to the shell such that when the shell rotates relative to the housing, the passageway is sealingly connected to the elongate chamber so that a partial vacuum is generated within the chamber for urging the web towards the perforate shell.

In a more specific embodiment of the present invention, the roll shell defines a plurality of radial holes and has a cylindrical outer surface. Furthermore, the holes extend from the outer surface to the elongate chamber.

Also, the guide roll apparatus includes a spider means which extends between the roll shell and the first and second shafts respectively for rigidly securing the shafts coaxially relative to the roll shell. More particularly, the spider means includes an inner plate rigidly secured to the one shaft and rigidly secured to the roll shell. The inner plate defines an opening such that the passageway is connected to the elongate chamber. Furthermore, an outer plate is rigidly secured to the one shaft and to the roll shell with the outer plate being spaced axially relative to the inner plate. The outer plate defines an orifice so that the passageway is connected to the elongate chamber.

The bearing that is disposed adjacent to the housing also includes a bearing shell which is rigidly secured to the housing such that the bearing shell and the housing remain stationary while permitting the roll shell and shaft to rotate relative thereto.

The housing also includes an air outlet which is connected to the source of partial vacuum such that in use of the apparatus, air flows through the shell, the elongate chamber, the passageway and the air inlet towards the source of partial vacuum. The arrangement is such that the web is urged towards the dryer felt and perforate shell for providing positive restraint of the web relative to the roll shell thereby inhibiting cockling and shrinkage of the web during transit of the web through the dryer section.

The air inlet is disposed between the first and the second annular seal means.

In a further embodiment of the present invention, a vacuum guide roll apparatus includes a housing and a further housing disposed respectively adjacent to a first and second shaft. The housing defines a passageway which is connected to a source of partial vacuum and a first annular seal means is disposed between the housing and the first shaft for sealing the housing relative to the first shaft. A second annular seal means is disposed between the housing and the shell for sealing the housing relative to the shell such that when the shell rotates relative to the housing, the passageway is sealingly connected to an elongate chamber so that a partial vacuum is generated within the chamber for urging the web towards the perforate shell.

Also, a further housing is disposed coaxially relative to the shell and adjacent to a second shaft. The further housing defines a further passageway which is also connected to the source of partial vacuum. A further first seal means is disposed between the further housing and the second shaft for sealing the further housing relative to the second shaft. A further second annular seal means is disposed between the further housing and the shell for sealing the further housing relative to the shell such that when the shell rotates relative to the further housing, the further passageway is sealingly connected to the elongate chamber so that a partial vacuum is generated within the chamber for urging the web towards the perforate shell.

The present invention also includes a method for guiding a web between an upstream dryer and a downstream dryer of a dryer section. The method includes the following steps:

A web is guided from the upstream dryer around a vacuum guide roll having a perforate shell. The shell has a first and second end and defines an elongate chamber which extends between the first and the second ends.

A first and second shaft are disposed coaxially relative to the shell adjacent to the first and the second ends respectively of the shell and are rigidly secured thereto. The shafts define respectively first and second journals.

The first and second journals are rotatably supported within first and second bearings such that the shell is rotatably supported by the bearings.

The shafts and the shell are rotated relative to a housing disposed coaxially relative to the shell. The housing defines a passageway which is connected to a source of partial vacuum.

The housing is sealed relative to the shell and the adjacent shaft such that when the housing is connected to the source of partial vacuum, air is drawn through the shell, the elongate chamber, and the passageway towards the source of partial vacuum. The arrangement is such that the web is drawn into close conformity with the perforate shell, thereby inhibiting cockling and shrinkage of the web during transit of the web through the dryer section.

Many modifications and variations of the present invention will be readily apparent to those skilled in the art by a consideration of the detailed description of a preferred embodiment of the present invention contained hereinafter taken in conjunction with the annexed drawings. However, such variations and modifications fall within the spirit and scope of the present invention as defined by the appended claims.

BRIEF DESCRIPTION OF THE DRAWING

Similar reference characters refer to similar parts throughout the various embodiments of the present invention.

DETAILED DESCRIPTION OF THE DRAWING

Figure 1:
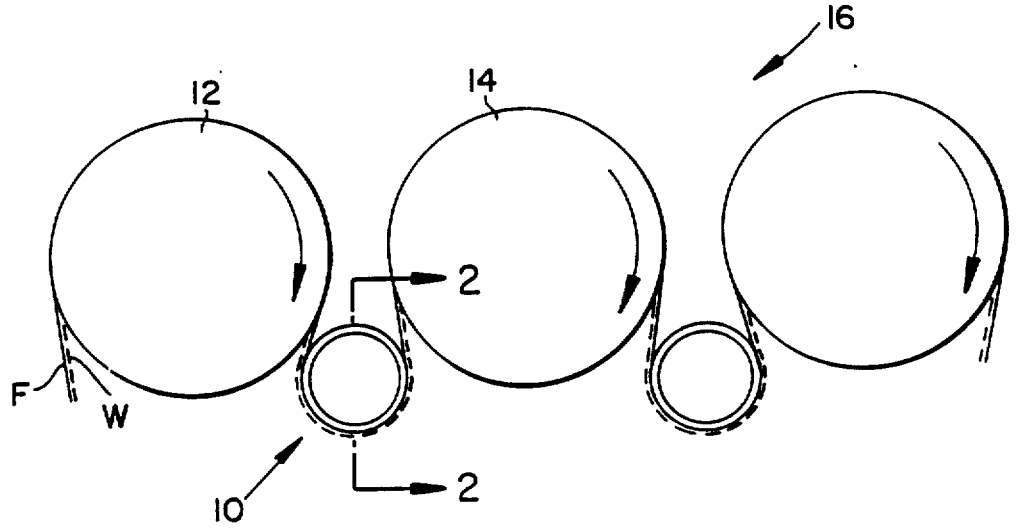
Figure 2:
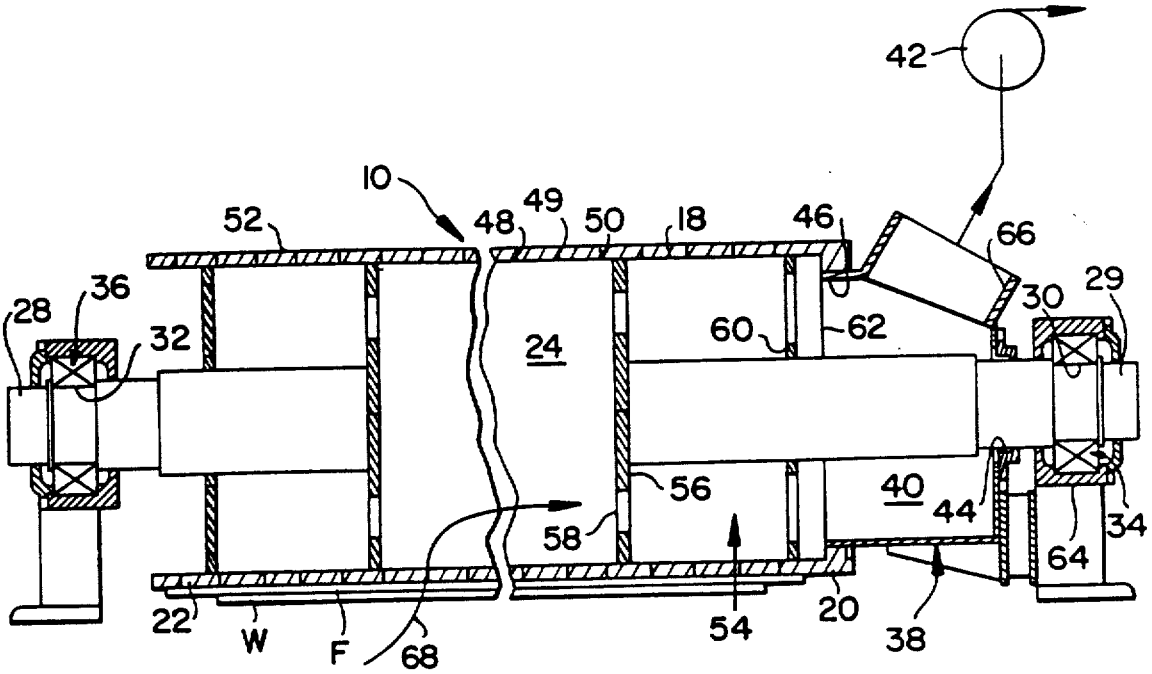
Figure 3:
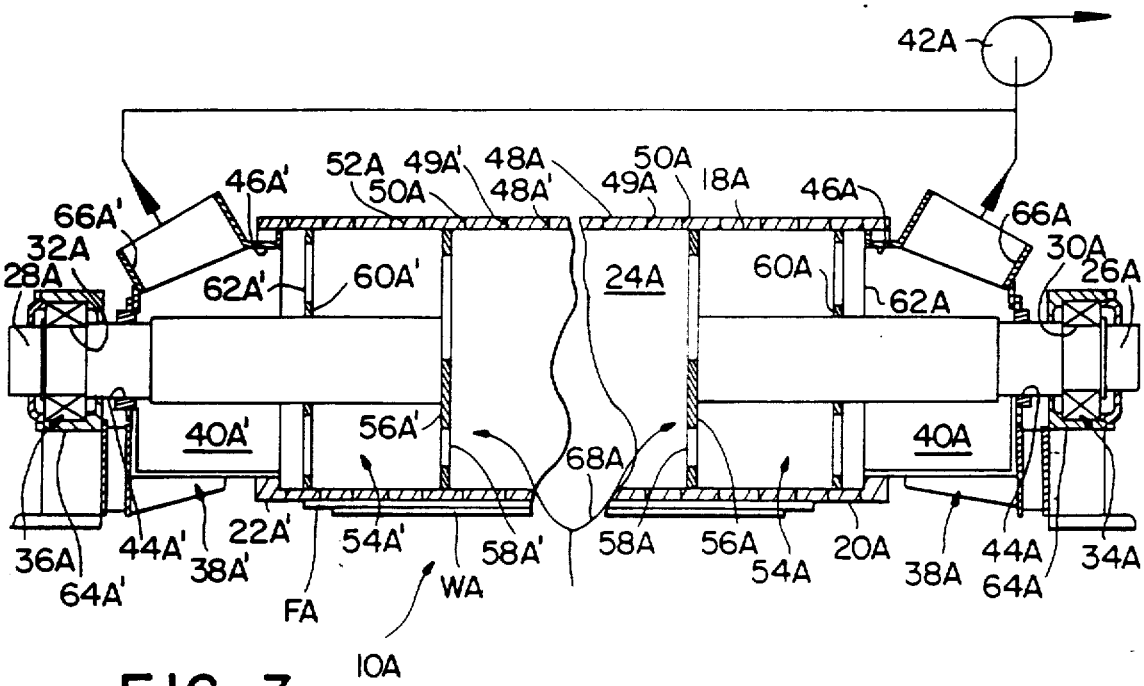
Figure 4:
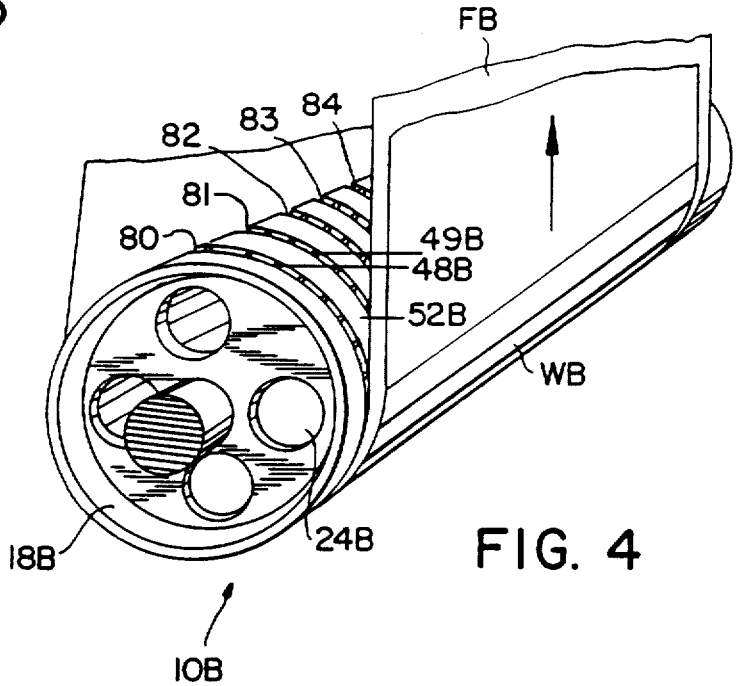

FIG. 1 is an elevational view of a vacuum guide roll apparatus generally designated 10 according to the present invention for guiding a web W between an upstream dryer 12 and a downstream dryer 14 of a dryer section generally designated 16.

Figure 1A:
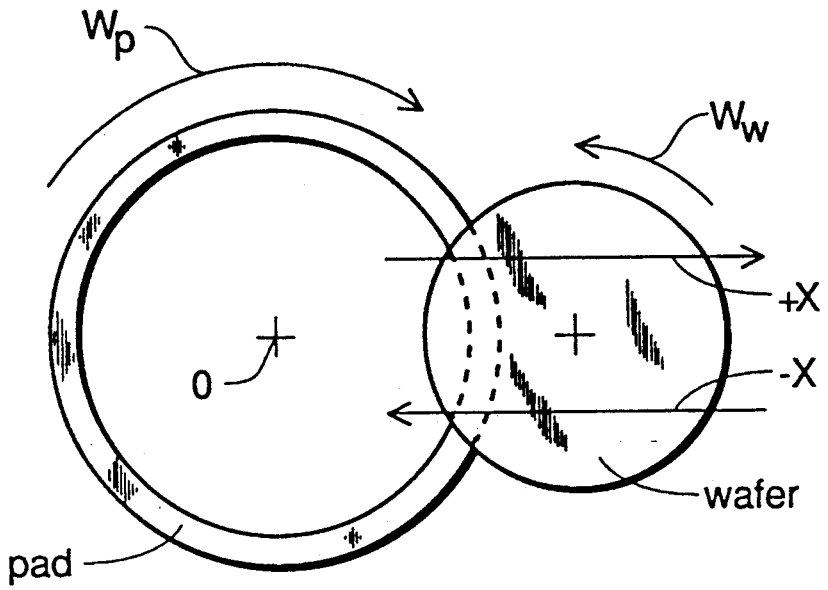
FIG. 1A (PRIOR ART)
FIG. 1 is a side-elevational view of a vacuum guide roll apparatus according to the present invention for guiding a web between an upstream dryer and a downstream dryer of a dryer section.
Figure 1B:
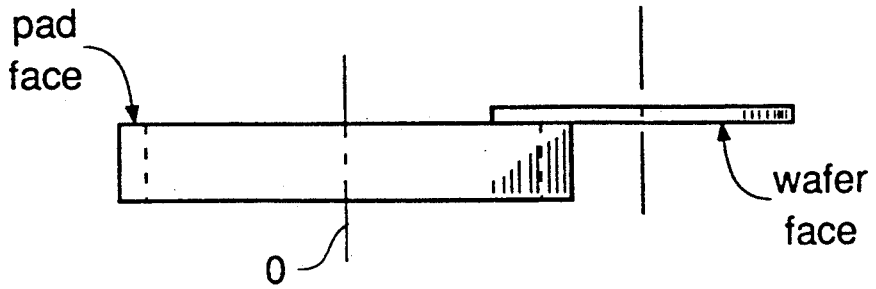
FIG. 1B (PRIOR ART)
Figure 2:
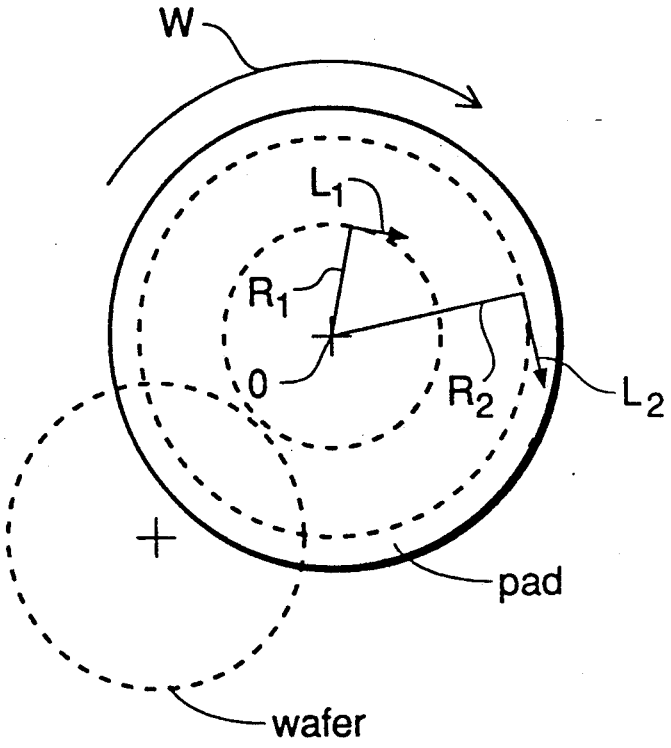
FIG. 2 is an enlarged fragmentary sectional view taken on the line 2—2 of FIG. 1 showing the vacuum guide roll apparatus.

FIG. 2 is an enlarged sectional view taken on the line 2—2 of FIG. 1 and shows the apparatus 10 as including a perforate roll shell 18 having a first and a second end 20 and 22 respectively. The shell 18 defines an elongate chamber 24 which extends between the first and second ends 20 and 22.

A first and second shaft 26 and 28 are rigidly secured to and disposed coaxially relative to the shell 18. The first and second shafts 26 and 28 are disposed adjacent to the first and second ends 20 and 22 respectively of the shell 18. The first shaft 26 defines a first journal 30 and the second shaft 28 defines a second journal 32.

A first and second bearing, generally designated 34 and 36 respectively, cooperate with the first and second journals 30 and 32 respectively for rotatably supporting the roll shell 18. A housing generally designated 38 is disposed coaxially relative to the shall 18 and adjacent to the first shaft 26. The housing 38 defines a passageway 40. The passageway 40 is connected to a source of partial vacuum 42.

A first annular seal means 44 is disposed between the housing 38 and the shaft 26 for sealing the housing 38 relative to the shaft 26.

A second annular seal means 46 is disposed between the housing 38 and the shell 18 for sealing the housing 38 relative to the shell 18 such that when the shell 18 rotates relative to the housing 38, the passageway 40 is sealingly connected to the elongate chamber 24 so that a partial vacuum is generated within the chamber 24 for urging the web W towards the perforate shell 18.

As shown in FIG. 2, the roll shell 18 defines a plurality of radial holes 48, 49 and 50 and a cylindrical outer surface 52. The holes 48 to 50 extend from the outer surface 52 to the elongate chamber 24.

The vacuum guide roll apparatus 10 also includes spider means generally designated 54 extending between the roll shell 18 and the first and second shafts 26 and 28 respectively for rigidly securing the shafts 26 and 28 coaxially relative to the roll shell 18.

More specifically, the spider means 54 further includes an inner plate 56 rigidly secured to the shaft 26 and rigidly secured within the roll shell 18. The inner plate 56 defines openings 58 such that the passageway 40 is connected to the elongate chamber 24.

An outer plate 60 is rigidly secured to the shaft 26 and to the roll shell 18. The outer plate 60 is spaced axially relative to the inner plate 56. The outer plate 60 defines orifices 62 so that the passageway 40 is connected to the elongate chamber 24.

As shown in FIG. 2, the bearing 34, which is disposed adjacent to the housing 38, also includes a bearing shell 64 which is rigidly secured to the housing 38 such that the bearing shell 64 and the housing 38 remain stationary while permitting the roll shell 18 and shafts 26 and 28 to rotate relative thereto.

The housing generally designated 38 also includes an air outlet 66 which is connected to the source of partial vacuum 42. The arrangement is such that in use of the apparatus 10, air flows as, indicated by the arrow 68, through the shell 18, the elongate chamber 24, the passageway 40 and the air inlet 66 towards the source of partial vacuum 42. The web W is therefore urged towards a dryer felt F and the perforate shell 18 for providing positive restraint of the web W relative to the felt F and roll shell 18 thereby inhibiting cockling and shrinkage of the web W during transit of the web W through the dryer section 16.

FIG. 2 also shows the air inlet 66 as being disposed between the first and second annular seal means 44 and 46 respectively.

Figure 3:
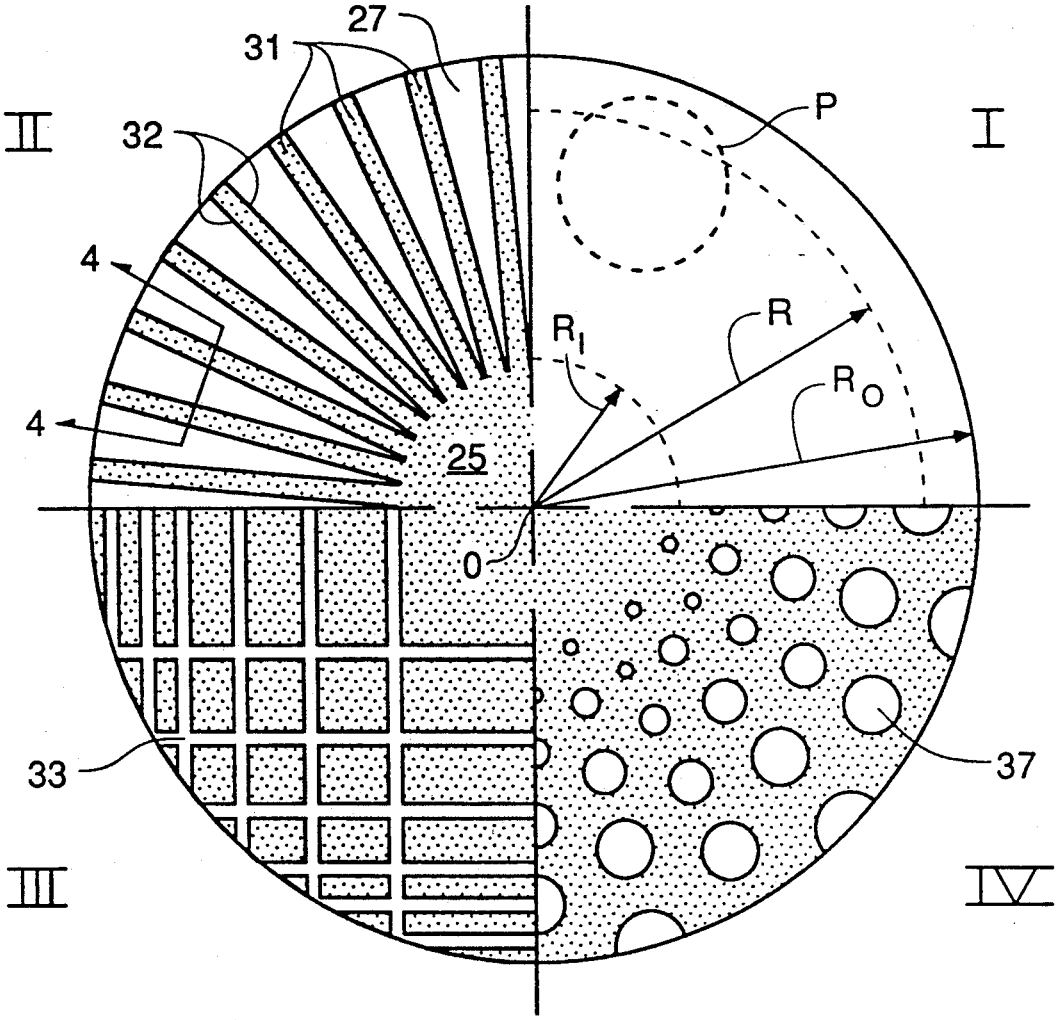
FIG. 3 is a similar view to that shown in FIG. 2 but shows a further embodiment of the present invention including a housing and a further housing.

FIG. 3 is a sectional view similar to that shown in FIG. 2 but shows an alternative embodiment of the present invention. More particularly, the apparatus 10A includes a perforate roll shell 18A having a first and second end 20A and 22A respectively. The shell 18A defines an elongate chamber 24A which extends between the first and the second ends 20A and 22A respectively.

A first and second shaft 26A and 28A are rigidly secured to and disposed coaxially relative to the shell 18A. The first and second shafts 26A and 28A are disposed adjacent to the first and second ends 20A and 22A respectively of the shell 18A. The first shaft 26A defines a first journal 30A and the second shaft 28A defines a second journal 32A.

A first and second bearing generally designated 34A and 36A respectively cooperate with the first and the second journals 30A and 32A respectively for rotatably supporting the roll shell 18A. A housing generally designated 38A is disposed coaxially relative to the shell 18A and adjacent to the first shaft 26A. The housing 38A defines a passageway 40A. The passageway 40A is connected to a source of partial vacuum 42A.

A first annular seal means 44A is disposed between the housing 38A and the shaft 26A for sealing the housing 38A relative to the shaft 26A.

A second annular seal means 46A is disposed between the housing 38A and the shell 18A for sealing the housing 38A relative to the shell 18A such that when the shell 18A rotates relative to the housing 38A, the passageway 40A is sealingly connected to the elongate chamber 24A so that a partial vacuum is generated within the chamber 24A for urging the web WA towards the perforate shell 18A.

A further housing generally designated $38A^1$ is disposed coaxially relative to the shell 18A and adjacent to the second shaft 28A. The further housing $38A^1$ defines a further passageway $40A^1$. The further passageway $40A^1$ is connected to the source of partial vacuum 42A. A further first annular seal means $44A^1$ is disposed between the further housing $38A^1$ and the shaft 28A for sealing the further housing $38A^1$ relative to the second shaft 28A.

A further second annular seal means $46A^1$ is disposed between the further housing $38A^1$ and the shell 18A for sealing the further housing $38A^1$ relative to the shell 18A such that when the shell 18A rotates relative to the further housing $38A^1$, the further passageway $40A^1$ is sealingly connected to the elongate chamber 24A so that a partial vacuum is generated within the chamber 24A for urging the web WA towards the perforate shell 18A.

As shown in FIG. 3, the roll shell 18A defines a plurality of radial holes 48A, 49A, 50A $48A^1$, $49A^1$ and $50A^1$. Also, the roll shell 18A defines an outer surface 52A. The radial holes extend from the outer surface 52A to the elongate chamber 24A.

The vacuum guide roll apparatus 10A also includes spider means generally designated 54A and $54A^1$ which extend between the roll shell 18A and the first and second shafts 26A and 28A respectively for rigidly securing the shafts 26A and 28A coaxially relative to the roll shell 18A.

More specifically, the spider means 54A further includes an inner plate 56A which is rigidly secured to the shaft 26A and rigidly secured within the roll shell 18A. The inner plate 56A defines an opening 58A such that the passageway 40A is connected to the elongate chamber 24A.

Also, a further spider means $54A^1$ includes an inner plate $56A^1$ which is rigidly secured to the second shaft 28A and rigidly secured within the roll shell 18A. The inner plate $56A^1$ defines a further opening $58A^1$ such that the further passageway 40A[1] is connected to the elongate chamber 24A.

An outer plate 60A is rigidly secured to the first shaft 26A and to the roll shell 18A. The outer plate 60A is spaced axially relative to the inner plate 56A. The outer plate 60A defines an orifice 62A so that the passageway 40A is connected to the elongate chamber 24A.

Also, a further outer plate 60A[1] is rigidly secured to the second shaft 28A and to the roll shell 18A. The plate 60A[1] is spaced axially relative to the inner plate 56A[1]. The outer plate 60A[1] defines an orifice 62Aso that the further passageway 40A[1] is connected to the elongate chamber 24A.

As shown in FIG. 3, the bearing 34A, which is disposed adjacent to the housing 38A, also includes a bearing shell 64A which is rigidly secured to the housing 38A such that the bearing shell 64A and the housing 38A remain stationary while permitting the roll shell 18A and shafts 26A and 28A to rotate relative thereto.

Similarly, the bearing 36A is disposed adjacent to the further housing 38A[1] and includes a bearing shell 64A[1] which is rigidly secured to the housing 38A[1] such that the bearing shell 64A[1] and the housing 38A[1] remain stationary while permitting the roll shell 18A and the shafts 26A and 28A to rotate relative thereto The housing and further housing 38A and 38A[1] respectively also include air outlets 66A and 66A[1] respectively which are connected to the source of partial vacuum 42A. The arrangement is such that in use of the apparatus 10A, air flows as indicated by the arrow 68A, through the shell 18A, the elongate chamber 24A, the passageway and further passageway 40A and 40A[1] respectively and the air inlet 66A and 66A[1] respectively towards the source of partial vacuum 42A. The web WA is therefore urged towards a dryer felt FA and the perforate shell 18A for providing positive restraint of the web WA relative to the felt FA and the roll shell 18A, thereby inhibiting cockling and shrinkage of the web WA during transit of the web WA through the dryer section.

The partial vacuum in chamber 24A improves the runnability by keeping the web in good contact with the felt. The passageways 40A and 40A[1] provided at each end of the perforate shell 18 hold the edges of the web and prevent shrinkage of the web. Therefore, by this means, cockle and curl of the web are inhibited.

Figure 4:
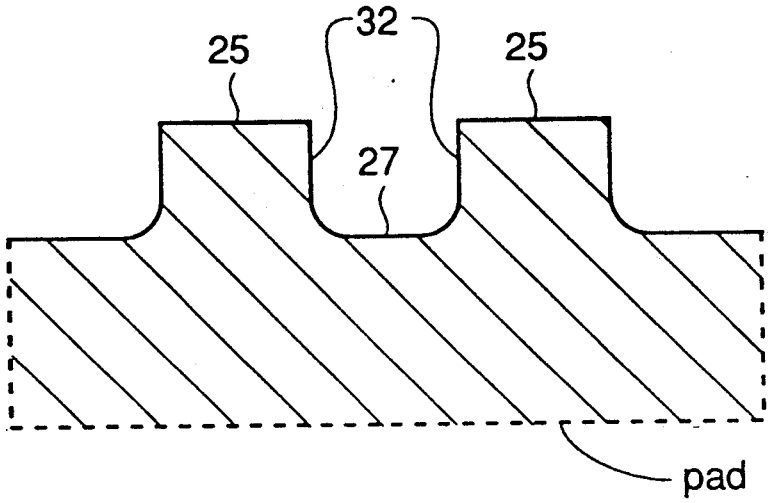
FIG. 4 is a perspective view of yet another embodiment of the present invention showing a vacuum guide roll apparatus in which the roll shell includes a plurality of circumferential grooves.
Figure 6:
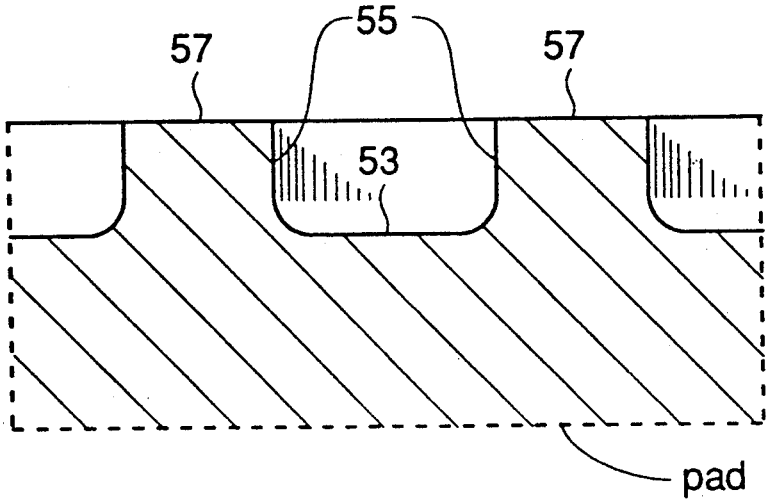
Figure 5:
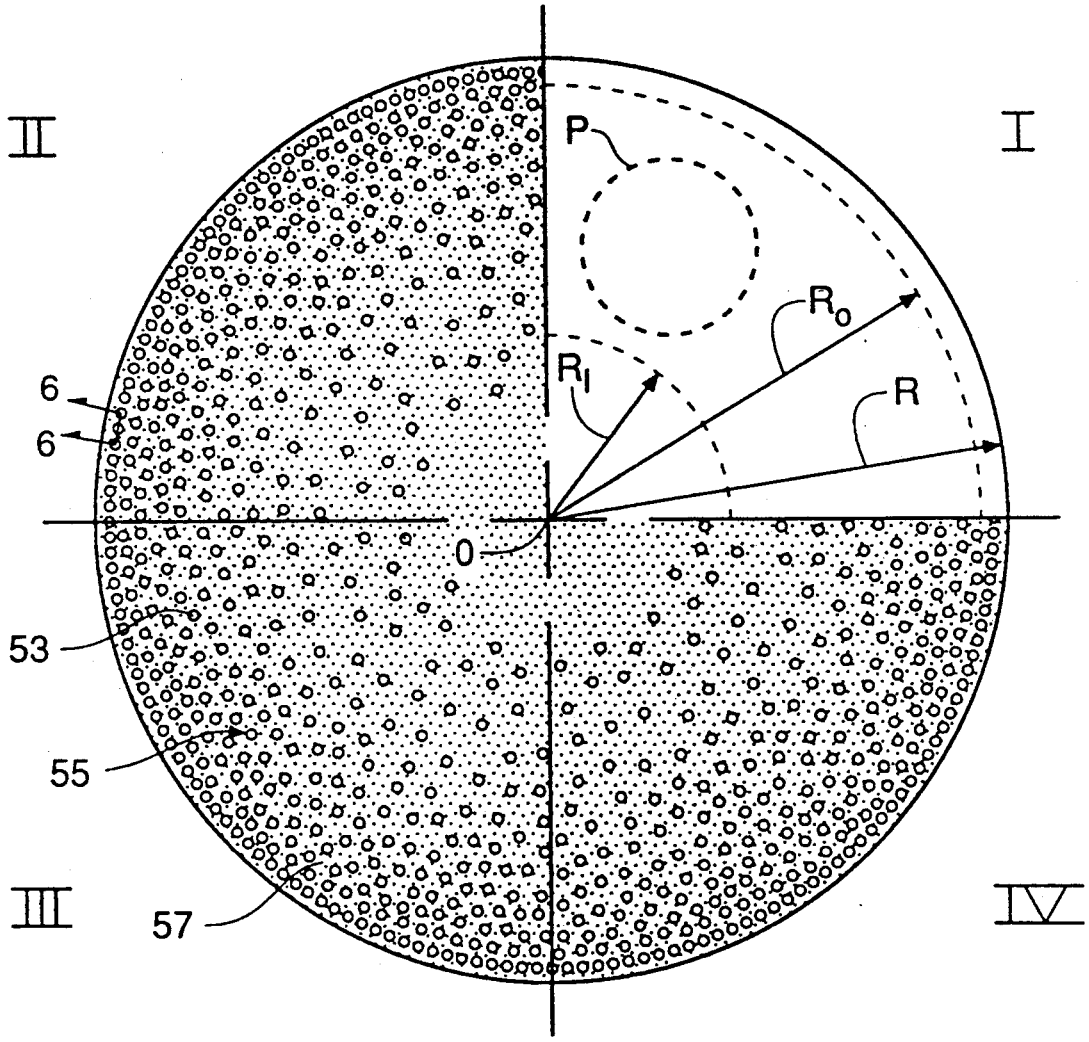

FIG. 4 is a perspective view partially in section of a vacuum guide roll apparatus according to a further embodiment of the present invention. More particularly, FIG. 4 shows a vacuum guide roll apparatus generally designated 10B for guiding a web WB between an upstream dryer and a downstream dryer of a dryer section. The apparatus 10B includes a perforate roll shell 18B. The arrangement shown in FIG. 4 is identical to the embodiment shown in FIG. 3 except in that the roll shell 18B is provided with a plurality of circumferential grooves 80, 81, 82, 83 and 84. The grooves 80–84 are defined by the outer surface 52B of the roll shell 18B. A plurality of radial holes 48B and 49B extend from an elongate chamber 24B to respective grooves 80 and 81. The grooves 80–84 assist in further urging the web WB into close conformity with the felt FB during transit of the web WB around the roll shell 18B.

In operation of the vacuum guide roll apparatus, as shown in FIGS. 1 and 2, the roll shell 18 and shafts 26 and 28 are rotatably supported by means of the bearings 34 and 36. However, the bearing shell 64, being rigidly secured to the housing 38, prevents rotation of the housing 38 relative to the roll shell 18. The housing 38 is connected to the source of partial vacuum 42 such that air is drawn through the plurality of holes 48–50 into the elongate chamber 24 and through the passageway 40 for urging the web into close conformity with the dryer felt F so that the web W is constrained against any shrinkage, thereby inhibiting cockling or curl in the resultant web.

The present invention provides an inexpensive vacuum guide roll that requires no center shaft. Consequently, such guide roll may be supported by smaller bearings and the vacuum is pulled through the roll shell via the stationary housing rather than through passageways defined by the bearing journals.

What is claimed:

1. A method for guiding a web between an upstream dryer and a downstream dryer of a dryer section, said method comprising the steps of:

guiding a web from the upstream dryer around a vacuum guide roll having a perforate shell, the shell having a first and second end, the shell defining an elongate chamber extending between the first and the second ends;

rigidly securing a first and second shaft disposed coaxially relative to the shell adjacent to the first and the second ends respectively of the shell, the shafts defining respectively first and second journals;

rotatably supporting the first and second journals within first and second bearings such that the roll shell is rotatably supported within the bearings;

rotating the shafts and the shell relative to a housing disposed coaxially relative to the shell, the housing defining a passageway connected to a source of partial vacuum; and sealing the housing relative to the shell and one of the shafts such that when the housing is connected to the source of partial vacuum, air is drawn through the shell, the elongate chamber, and the passageway towards the source of partial vacuum so that the web is drawn into close conformity with the perforate shell, thereby inhibiting cockling and shrinkage of the web during transit of the web through the dryer section.

2. A method for guiding a web between an upstream dryer and a downstream dryer of a dryer section, said method comprising the steps of:

guiding a web from the upstream dryer around a vacuum guide roll having a perforate shell, the shell having a first and second end, the shell defining an elongate chamber extending between the first and the second ends;

rigidly securing a first and second shaft disposed coaxially relative to the shell adjacent to the first and the second ends respectively of the shell, the shafts defining respectively first and second journals;

rotatably supporting the first and second journals within first and second bearings such that the roll shell is rotatably supported within the bearings;

rotating the shafts and the shell relative to a housing and a further housing disposed adjacent to the first and second shafts respectively, the housing and the further housing being disposed coaxially relative to the shell, the housing and the further housing defining respectively a passageway and a further passageway, both connected to a source of partial vacuum;

sealing the housing relative to the shell and the first shaft such that when the housing is connected to the source of partial vacuum, air is drawn through the shell, the elongate chamber, and the passageway towards the source of partial vacuum so that the web is drawn into close conformity with the perforate shell, thereby inhibiting cockling and shrinkage of the web during transit of the web through the dryer section; and sealing the further housing relative to the shell and the second shaft such that when the further housing is connected to the source of partial vacuum, air is drawn through the shell, the elongate chamber, and the further passageway towards the source of partial vacuum so that the web is drawn into close conformity with the perforate shell, thereby inhibiting cockling and shrinkage of the web during transit of the web through the dryer section.

* * * * *

UNITED STATES PATENT AND TRADEMARK OFFICE

CERTIFICATE OF CORRECTION

PATENT NO. : 5,020,238

DATED : June 4, 1991

INVENTOR(S) : Gregory L. Wedel et al

It is certified that error appears in the above-identified patent and that said Letters Patent is hereby corrected as shown below:

The title page should be deleted to appear as per attached title page.

The sheet of Drawings consisting of Fig. 1 thru 4 should be added as per attached sheet.

Signed and Sealed this

Seventh Day of April, 1992

*Attest:*

HARRY F. MANBECK, JR.

*Attesting Officer*

*Commissioner of Patents and Trademarks*

United States Patent [19]
Wedel et al.

[11] Patent Number: 5,020,238
[45] Date of Patent: Jun. 4, 1991

[54] VACUUM GUIDE ROLL APPARATUS

[75] Inventors: Gregory L. Wedel; Arnold J. Roerig, both of Beloit, Wis.

[73] Assignee: Beloit Corporation, Beloit, Wis.

[21] Appl. No.: 525,380

[22] Filed: May 17, 1990

Related U.S. Application Data

[62] Division of Ser. No. 429,592, Oct. 31, 1989, Pat. No. 4,974,340.

[51] Int. Cl.[5] ..... F26B 5/04; F26B 11/02
[52] U.S. Cl. ..... 34/16; 34/115
[58] Field of Search ..... 34/115, 116, 117, 120, 34/123, 114, 15, 16, 92

[56] References Cited

U.S. PATENT DOCUMENTS 4,364,185 12/1982 Dussourd et al. ..... 34/115

*Primary Examiner*—Henry A. Bennet
*Attorney, Agent, or Firm*—Dirk J. Veneman; Raymond W. Campbell; David J. Archer

[57] ABSTRACT

A vacuum guide roll apparatus is disclosed for guiding a web between an upstream dryer and a downstream dryer of a dryer section. The apparatus includes a perforate roll shell having a first and a second end. The shell defines an elongate chamber which extends between the first and the second ends. A first and second shaft are rigidly secured to and disposed coaxially relative to the shell. The shafts are disposed adjacent to the first and second ends respectively of the shell. The shafts define respectively a first and second journal. A first and second bearing cooperate with the first and second journals respectively for rotatably supporting the roll shell. A housing is disposed coaxially relative to the shell and adjacent to one of the shafts. The housing defines a passageway which is connected to a source of partial vacuum. A first annular seal is disposed between the housing and the one shaft for sealing the housing relative to the one shaft. A second annular seal is disposed between the housing and the shell for sealing the housing relative to the shell so that when the shell rotates relative to the housing, the passageway is sealingly connected to the elongate chamber such that a partial vacuum is generated within the chamber for urging the web towards the perforate shell.

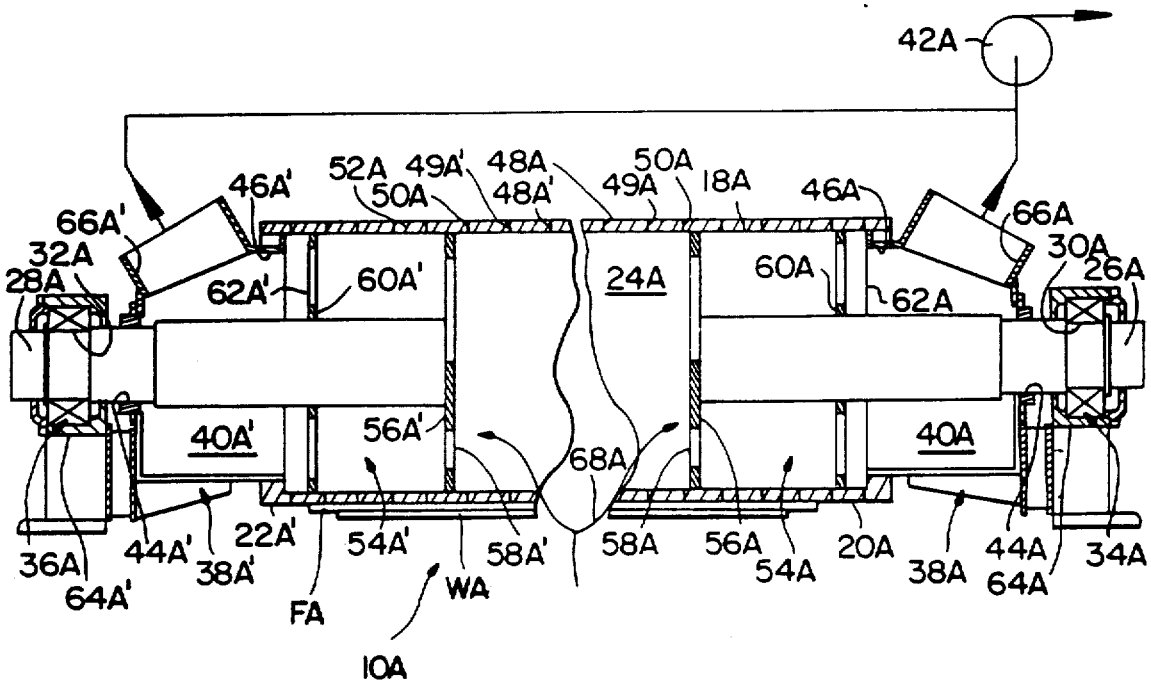

2 Claims, 2 Drawing Sheets